US005732530A

United States Patent [19]

Pfaff

[11] Patent Number: 5,732,530

[45] Date of Patent: Mar. 31, 1998

[54] METHOD OF SEALING A BALLOON AFTER IT IS INFLATED

[76] Inventor: Kathleen Sue Pfaff, 1300 SW. Wellington Ave., Port Saint Lucie, Fla. 34953

[21] Appl. No.: 825,966

[22] Filed: Apr. 4, 1997

Related U.S. Application Data

[63] Continuation of Ser. No. 561,040, Nov. 20, 1995, abandoned.

[51] Int. Cl.[6] ..... B65B 51/09; B65B 51/04

[52] U.S. Cl. ..... 53/403; 53/417; 53/138.4; 446/222; 24/30.5 W; 72/409.19; 72/416; 29/243.56

[58] Field of Search ..... 446/222, 220; 24/30.55, 30.5 W, 20 W; 72/409.13–409.15, 409.01, 409.19, 416; 29/243.56, 515; 53/138.4, 403, 417, 469; 140/93 D, 93.4, 106

[56] References Cited

U.S. PATENT DOCUMENTS

| | | | |
|---|---|---|---|
| D. 282,487 | 2/1986 | Green | D24/26 |
| 2,093,900 | 9/1937 | Wilson | 140/93 D |
| 2,208,819 | 7/1940 | Smith | 140/93 D |
| 2,493,063 | 1/1950 | Frank | 24/30.5 S |
| 2,670,294 | 2/1954 | Frank | 53/417 |
| 2,886,816 | 5/1959 | Hill | 29/243.57 |
| 3,011,690 | 12/1961 | Gabuzda | 24/30.5 W |
| 3,055,010 | 9/1962 | Maestri | 29/243.57 |
| 3,057,233 | 10/1962 | Turner | 72/416 |
| 3,236,005 | 2/1966 | Tomosy | 446/222 |
| 3,503,119 | 3/1970 | Seitz | 29/515 |
| 3,879,981 | 4/1975 | Richards | 140/93 D |
| 3,908,234 | 9/1975 | Niedecker | 24/30.5 W |
| 3,914,980 | 10/1975 | Niedecker | 29/243.56 |
| 4,313,333 | 2/1982 | Malagnoux et al. | 29/243.56 |
| 4,380,103 | 4/1983 | McGrath | 446/222 |
| 4,694,554 | 9/1987 | McGrath | 29/235 |
| 4,787,236 | 11/1988 | West . | |
| 5,123,273 | 6/1992 | Kawabata | 29/243.56 |
| 5,282,807 | 2/1994 | Knoepfler . | |
| 5,305,628 | 4/1994 | Cluggish | 29/243.56 |

FOREIGN PATENT DOCUMENTS

| | | | |
|---|---|---|---|
| 228276 | 3/1959 | Australia | 24/30.5 W |
| 971005 | 11/1958 | Germany | 29/243.57 |
| 1101557 | 3/1961 | Germany | 29/243.57 |
| 1942413 | 4/1971 | Germany | 72/409.19 |
| 227932 | 11/1985 | Japan | 72/416 |
| 78678 | 10/1933 | Sweden | 72/409.01 |

*Primary Examiner*—Daniel C. Crane

[57] ABSTRACT

A balloon clamp apparatus seals an inflation passageway of an inflated balloon and includes a clip member which includes a central portion, a first extension portion connected to the central portion, and a second extension portion connected to the central portion. The first extension portion and the second extension portion extend in a common direction from the central portion. The clip member includes a gap between the first extension portion and the second extension portion. The gap is for receiving the inflation passageway of the balloon. A pliers assembly includes a pair of handle portions, a fulcrum portion to which the pair of handle portions are connected, and a pair of clamp members connected to the pair of handle portions. The first extension portion, the central portion, the second extension portion, and the gap of the clip member can be formed as a C-shaped clip member. Also, each of the clamp members includes a semi-cylindrical ridge-retention portion, and each ridge portion is semi-circular and is retained in a semi-cylindrical ridge-retention portion. With the C-shaped clip member, the ridge portions of the clamp members compress and deform a portion of the first extension portion, a portion of the central portion, and a portion of the second extension portion of the clip member against the inflation passageway of the balloon for sealing the inflation passageway. As this is done, the gap is closed.

1 Claim, 2 Drawing Sheets

FIG 1
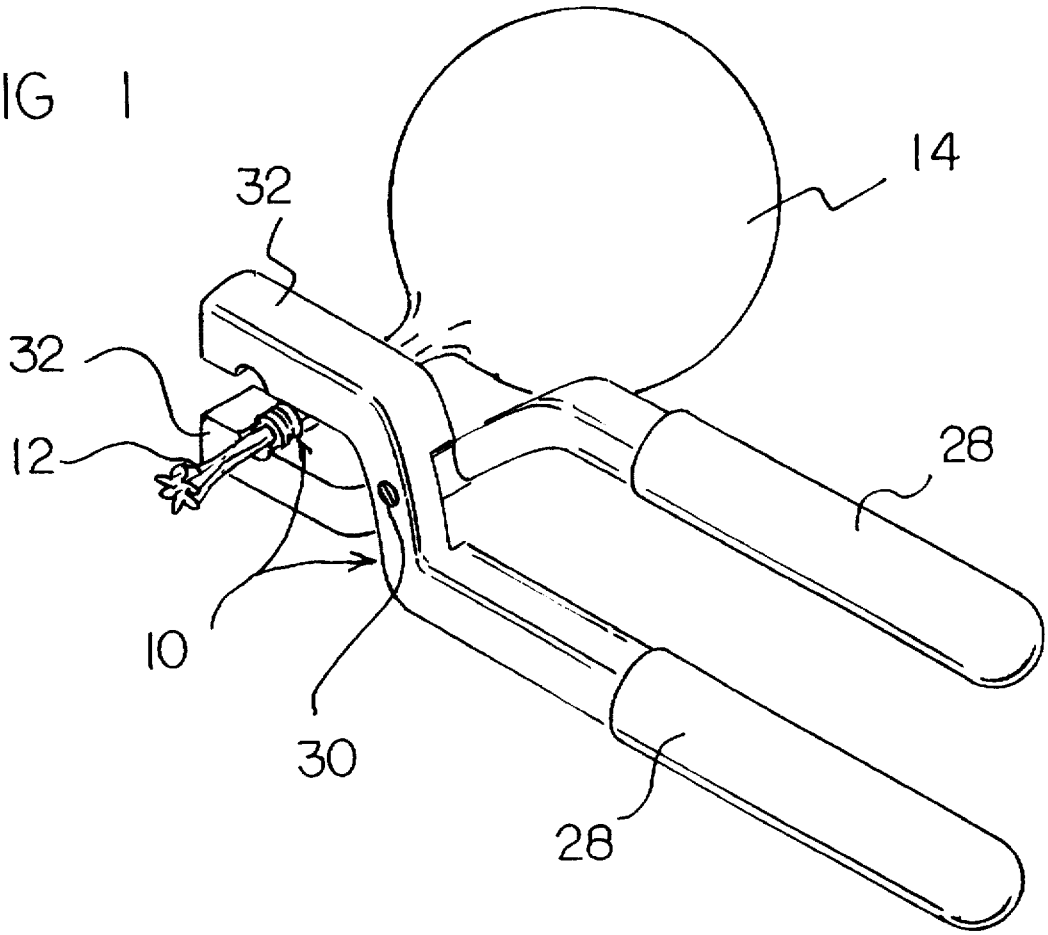
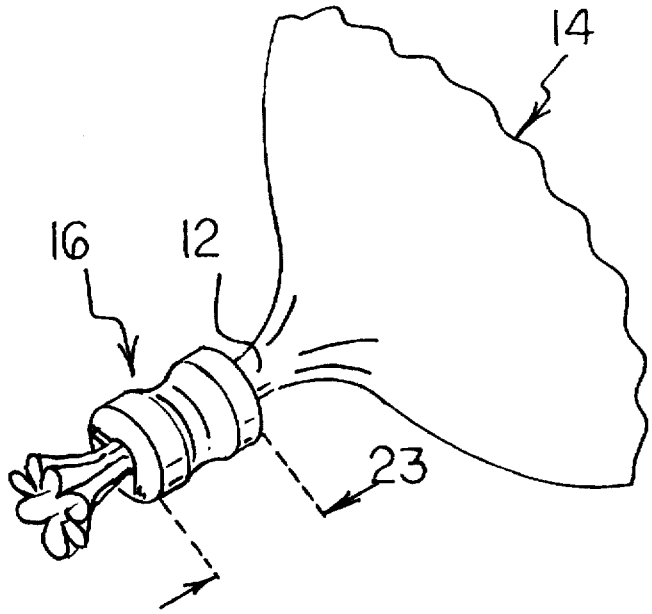
FIG 2

FIG 3
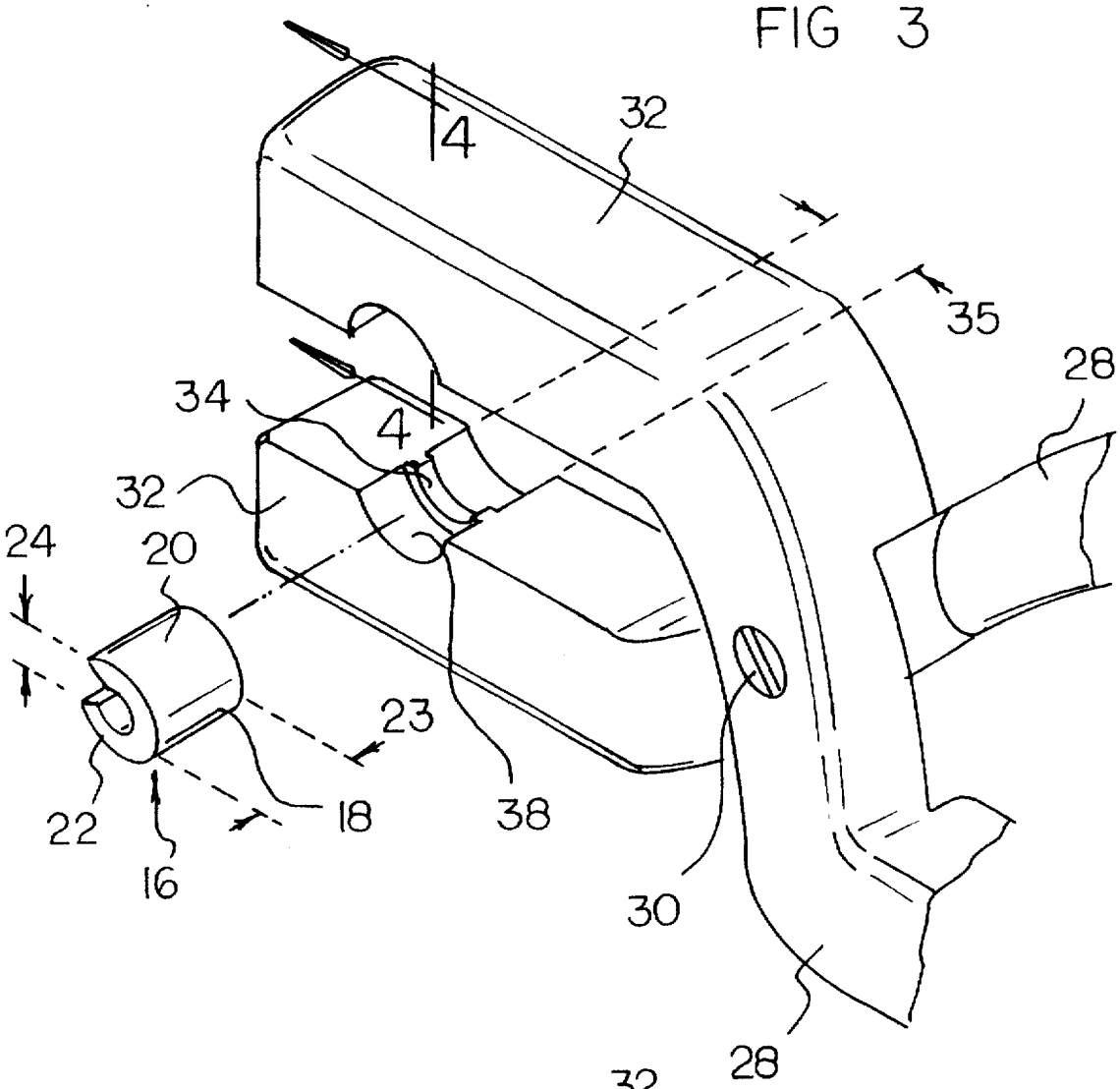
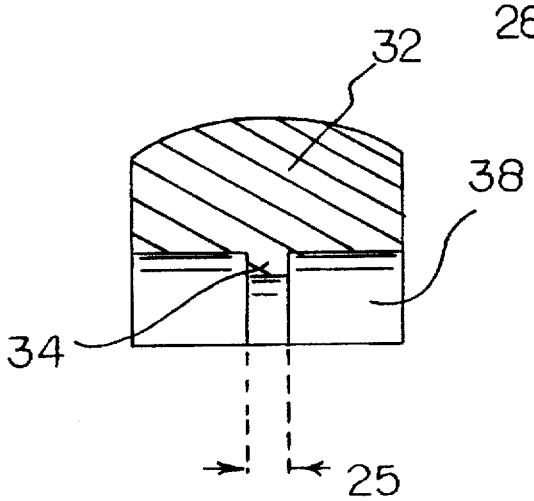
FIG 4

METHOD OF SEALING A BALLOON AFTER IT IS INFLATED

This application is a continuation of application Ser. No. 08/561,040, filed Nov. 20. 1995, now abandoned.

BACKGROUND OF THE INVENTION

1. Field of the Invention

The present invention relates generally to devices for sealing objects containing pressurized gas and, more particularly, to devices especially adapted for sealing inflated balloons.

2. Description of the Prior Art

Inflated balloons are popular decorations, especially at festive occasions such as parties, weddings, and graduations, among others. Balloons are also used for decorating floral arrangements. Balloons are often latex or other form of rubber. Generally, each balloon is inflated, and each balloon must be sealed to prevent the pressurized gas from leaking out through the inflation passageway. Often, the balloons are sealed manually by stretching the inflation passageway and tying the stretched inflation passageway into a knot. Considerable manual dexterity and finger strength are often required to the stretch the inflation passageway and to tie the stretched inflation passageway into a knot. This may be so for only one balloon. However, when balloons are used as decorations, often many balloons are employed. In this regard, many inflation passageways must be stretched and tied into knots. Such a required repetitive stretching and tying of inflation passageways may be difficult or impossible for any person. Unpleasant hand and finger fatigue may be an unavoidable consequence. In this respect, it would be desirable if a device were provided which permitted a plurality of inflated balloons to be sealed without a need for manually stretching and tying balloon inflation passageways.

Generally speaking, the concept of employing a clip or a ring in place of a rope or a string for binding objects together has been developed throughout the years in a number of ways, and the following U.S. patents are representative of some of those ways: U.S. Pat. Nos. 4,313,333, 4,787,236, 5,123,273, 5,282,807, 5,305,628, and Des. 282,487. More specifically, U.S. Pat. No. 4,313,333 discloses a special pliers for bending a clip to form a U-shape for use in wire netting. It is noted that such a U-shaped clip cannot be used for sealing an inflation passageway of an inflated balloon. In addition, each of U.S. Pat. Nos. 4,787,236, 5,123,273, and 5,305,628 discloses a hog ring applier. A ring in general and a hog ring in particular cannot be used for sealing an inflation passageway of an inflated balloon. In view of the above, it would be desirable if a device provided a clip that can be used for sealing an inflation passageway of an inflated balloon.

U.S. Pat. No. 5,282,807 discloses a stapler having a long shaft for remote stapling of internal body parts during surgery. The staples do not seal an inflation passageway of an inflated balloon. In addition, such a remotely controlled stapler would not be practical in sealing an inflation passageway which is near to, not remote from, a person's hand which holds the inflation passageway. In this respect, it would be desirable if a device were provided for sealing an inflation passageway of a balloon which seals the inflation passageway while the person is holding the inflation passageway. Moreover, a cutter is provided at the end of the stapler for cutting tissues during surgery. The presence of such a cutter would present a tremendous hazard to an inflated balloon. In this respect, it would be desirable if a device were provided for sealing the inflation passageway of a balloon without employing a cutter.

As a matter of interest, U.S. Pat. No. Des. 282,487 discloses a disposable cartridge which contains plastic staples. It is noted that staples are, by definition, objects which have two points that are driven into material. Clearly, staples cannot be used for sealing the inflation passageway.

Thus, while the foregoing body of prior art indicates it to be well known to use devices for installing U-shaped clips, rings, and staples, the prior art described above does not teach or suggest a balloon clamp apparatus which has the following combination of desirable features: (1) permits a plurality of inflated balloons to be sealed without a need for manually stretching and tying balloon inflation passageways; (2) provides a clip that can be used for sealing an inflation passageway of an inflated balloon; (3) seals the inflation passageway while the person is holding the inflation passageway; (4) does not employ a cutter; and (5) seals the inflation passageway of a balloon without using staples. The foregoing desired characteristics are provided by the unique balloon clamp apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a balloon clamp apparatus which seals an inflation passageway of an inflated balloon and includes a clip member which includes a central portion, a first extension portion connected to the central portion, and a second extension portion connected to the central portion. The first extension portion and the second extension portion extend in a common direction from the central portion. The clip member includes a gap between the first extension portion and the second extension portion. The gap is for receiving the inflation passageway of the balloon. A pliers assembly includes a pair of handle portions, a fulcrum portion to which the pair of handle portions are connected, and a pair of clamp members connected to the pair of handle portions. Each of the clamp members includes a ridge portion for compressing and deforming a portion of the first extension portion and a portion of the second extension portion of the clip member against the inflation passageway of the balloon for sealing the inflation passageway.

The first extension portion, the central portion, the second extension portion, and the gap of the clip member can be formed as a C-shaped clip member. Each of the clamp members includes a semi-cylindrical ridge-retention portion, and each ridge portion is semi-circular and is retained in a semi-cylindrical ridge-retention portion. The clip member has a clip width. Each of the ridge portions of the clamp members has a ridge width. The ridge width is less than the clip width. With the C-shaped clip member, the ridge portions of the clamp members compress and deform a portion of the first extension portion, a portion of the central portion, and a portion of the second extension portion of the clip member against the inflation passageway of the balloon for sealing the inflation passageway. As this is done, the gap is closed.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved balloon clamp apparatus which has all of the advantages of the prior art and none of the disadvantages.

It is another object of the present invention to provide a new and improved balloon clamp apparatus which may be easily and efficiently manufactured and marketed.

It is a further object of the present invention to provide a new and improved balloon clamp apparatus which is of durable and reliable construction.

An even further object of the present invention is to provide a new and improved balloon clamp apparatus which is susceptible of a low cost of manufacture with regard to both materials and labor, and which accordingly is then susceptible of low prices of sale to the consuming public, thereby making such balloon clamp apparatus available to the buying public.

Still yet a further object of the present invention is to provide a new and improved balloon clamp apparatus which permits a plurality of inflated balloons to be sealed without a need for manually stretching and tying balloon inflation passageways.

Still another object of the present invention is to provide a new and improved balloon clamp apparatus that provides a clip that can be used for sealing an inflation passageway of an inflated balloon.

Yet another object of the present invention is to provide a new and improved balloon clamp apparatus which seals the inflation passageway while the person is holding the inflation passageway.

Even another object of the present invention is to provide a new and improved balloon clamp apparatus that does not employ a cutter.

Still a further object of the present invention is to provide a new and improved balloon clamp apparatus which seals the inflation passageway of a balloon without using staples.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the balloon clamp apparatus of the invention in use on an inflation passageway of an inflated balloon.

FIG. 2 is an enlarged perspective view of a clip member of the embodiment of the balloon clamp apparatus shown in FIG. 1 installed on the inflation passageway of the balloon to provide a seal for gases inside the inflated balloon.

FIG. 3 is a partially exploded partial perspective view of the clip member and the clamping members of the clip-installing pliers of the embodiment of the invention shown in FIG. 1.

FIG. 4 is an enlarged partial cross-sectional view of one of the clamping members of the clip-installing pliers shown in FIG. 3 taken along line 4—4 thereof.

DESCRIPTION OF THE PREFERRED EMBODIMENT

With reference to the drawings, a new and improved balloon clamp apparatus embodying the principles and concepts of the present invention will be described.

Turning to FIGS. 1–4, there is shown an exemplary embodiment of the balloon clamp apparatus of the invention generally designated by reference numeral 10. The balloon clamp apparatus 10 seals an inflation passageway 12 of an inflated balloon 14 and includes a clip member 16 which includes a central portion 18, a first extension portion 20 connected to the central portion 18, and a second extension portion 22 connected to the central portion 18. The first extension portion 20 and the second extension portion 22 extend in a common direction from the central portion 18. The clip member 16 includes a gap 24 between the first extension portion 20 and the second extension portion 22. The gap 24 is for receiving the inflation passageway 12 of the balloon 14. A pliers assembly includes a pair of handle portions 28, a fulcrum portion 30 to which the pair of handle portions 28 are connected, and a pair of clamp members 32 connected to the pair of handle portions 28. Each of the clamp members 32 includes a ridge portion 34 for compressing and deforming a portion of the first extension portion 20 and a portion of the second extension portion 22 of the clip member 16 against the inflation passageway 12 of the balloon 14 for sealing the inflation passageway 12.

The first extension portion 20, the central portion 18, the second extension portion 22, and the gap 24 of the clip member 16 can be formed as a C-shaped clip member 16. Each of the clamp members 32 includes a semi-cylindrical ridge-retention portion 38, and each ridge portion 34 is semi-circular and is retained in a semi-cylindrical ridge-retention portion 38.

The clip member 16 has a clip width 23. Each of the ridge portions 34 of the clamp members 32 has a ridge width 25, the ridge width 25 is less than the clip width 23.

Alternatively, the first extension portion 20 and the second extension portion 22 can extend a clip-member length 21 in a common direction from the central portion 18 of the clip member 16. Then, each of the ridge portions 34 has a ridge length 35. The ridge length 35 is greater than the clip-member length 21. With this arrangement, the full clip-member length 21 of the clip member 16 is compressed by the ridge portions 34 so that a complete seal is made by the clip member 16 against the inflation passageway 12 of the inflated balloon 14.

In using the embodiment of the invention shown in the drawings, the pliers assembly is adjusted so that the clamp members 32 are separated. A person inflates a balloon 14 through the inflation passageway 12. Then, the person moves a portion of the inflation passageway 12 past the gap 24 in the C-shaped clip member 16 so that the inflation passageway 12 is encompassed by the clip member 16. Then, the person places the clip member 16 into one of the ridge-retention portions 38 of a clamp member 32. Then, the person grasps the handle portions 28 of the pliers assembly and squeezes them together. As a result, the clamp members 32 are moved together. As this is done, the ridge portion 34 on each clamp member 32 squeezes the clip member 16 with the inflation passageway 12 of the balloon 14 therebetween. The ridge portions 34 squeeze the clip member 16 such that the clip member 16 is deformed around the inflation passageway 12, and the clip member 16 retains its deformed shaped. In this way, the inflation passageway 12 is sealed by the clip member 16 so that air in the inflated balloon 14 does not leak out of the inflation passageway 12. FIG. 2 shows a clip member 16 deformed and sealing the inflation passageway 12 of the balloon 14.

The components of the balloon clamp apparatus of the invention can be made from inexpensive and durable metal and plastic materials. More specifically, the materials selected for the clip member 16 are inelastic materials which, when deformed by the ridge portions 34, remain deformed, and do not return to their original shape. Plastics are well known to have such inelastic properties. In addition, metals also have such inelastic properties. Lead metal is one such inelastic metal.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved balloon clamp apparatus that is low in cost, relatively simple in design and operation, and which may advantageously be used to seal a plurality of inflated balloons without a need for manually stretching and tying balloon inflation passageways. With the invention, a balloon clamp apparatus provides a clip that can be used for sealing an inflation passageway of an inflated balloon. With the invention, a balloon clamp apparatus is provided which seals the inflation passageway while the person is holding the inflation passageway. With the invention, a balloon clamp apparatus is provided which does not employ a cutter. With the invention, a balloon clamp apparatus is provided which seals the inflation passageway of a balloon without using staples.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. The method of sealing a balloon after it has been inflated comprising the following steps:

(a) providing a balloon clamp apparatus for sealing the inflation passageway of said inflated balloon, comprising:

a clip member which includes a central portion having a gap adapted to receive the inflation passageway of the balloon after the balloon is inflated, and a pliers assembly which includes a pair of handle portions, a fulcrum portion to which said pair of handle portions are connected, and a pair of clamp members connected to said pair of handle portions, wherein each of said clamp members includes a ridge portion positioned in a center and spaced from opposed outer lateral edges of the respective clamp member, the ridge portion being adapted for compressing said clip member and deforming a center portion spaced from opposed outer lateral edges of said clip member after said inflation passageway is received therein, (b) providing a balloon to be inflated, (c) inflating said balloon, (d) placing said clip member about said inflation passageway of said balloon, (e) placing said inflation passageway and said clip member thereon between the clamp members of said pliers, and (f) squeezing said handle members of said pliers assembly together to radially compress said clip member and deform a center portion spaced from opposed outer lateral edges of said clip member with respect to said inflation passageway thereby to seal said inflated balloon, whereby said clip member is deformed such that an interior surface of said clip member tapers from a first diameter at a first one of said outer lateral edges of the clip member to a second diameter less than said first diameter at said center portion of said clip member and back to said first diameter at a second one of said outer lateral edges of said clip member, whereby less compressive force is exerted between said interior surface of said clip member and said inflation passageway at said outer lateral edges of said clip member than at said center portion of said clip member.

* * * * *